US006000836A

United States Patent [19]

Nemazi et al.

[11] Patent Number: 6,000,836

[45] Date of Patent: Dec. 14, 1999

[54] PORTABLE MIXER AND MIXING BLADE ASSEMBLY

[75] Inventors: John E. Nemazi, Bloomfield Hills, Mich.; Joseph E. Davis, Anderson, S.C.

[73] Assignee: Ryobi North America, Inc., Anderson, S.C.

[21] Appl. No.: 09/047,565

[22] Filed: Mar. 25, 1998

[51] Int. Cl.[6] ..... B28C 5/08

[52] U.S. Cl. ..... 366/64; 366/129

[58] Field of Search ..... 366/64, 65, 66, 366/129, 130, 292, 293; 416/195; 172/41, 42, 57, 60, 123, 557

[56] References Cited

U.S. PATENT DOCUMENTS

| | | | |
|---|---|---|---|
| 1,593,706 | 7/1926 | Skoog . | |
| 3,031,018 | 4/1962 | Smithers . | |
| 3,042,434 | 7/1962 | Heiniger . | |
| 3,185,451 | 5/1965 | Snyder . | |
| 4,074,764 | 2/1978 | Enters . | |
| 4,213,504 | 7/1980 | Schneider | 172/41 |
| 4,256,183 | 3/1981 | Hanley . | |
| 5,401,098 | 3/1995 | Vadnais . | |
| 5,772,318 | 6/1998 | Vadnais | 366/64 |

FOREIGN PATENT DOCUMENTS

WO 96/30179 3/1996 WIPO .

*Primary Examiner*—Charles E. Cooley
*Attorney, Agent, or Firm*—Brooks & Kushman P.C.

[57] ABSTRACT

A portable mixer for use for use with an open top mixing container for mixing concrete or the like as having a pair of inboard rotary mixing blades and a pair of outboard mixing blade assemblies mounted on a generally horizontal rotary shaft. The outboard mixing blades are made up of a central hub removably affixed to the shaft. A peripheral ring extends about the hub and is connected to by a plurality of spokes. The peripheral ring has a diameter greater than that of the intermediate blades in order to prevent the intermediate blades from engaging the mixing container. A plurality of rotary disc blades are pivotally mounted on one of the plurality of spokes. The rotary disc blades have a diameter sufficiently large to cause a portion of the rotary disc blades to extend outwardly beyond the peripheral ring in order to engage the mixing container sidewalls.

8 Claims, 2 Drawing Sheets

PORTABLE MIXER AND MIXING BLADE ASSEMBLY

TECHNICAL FIELD

This invention relates to portable mixers particularly of the hand-held type used to mix cement, mortar, epoxy or the like.

BACKGROUND OF THE INVENTION

A portable mixer of the general type disclosed herein is illustrated in U.S. Pat. No. 5,401,098, to Vadnais and the related PCT application Wo 96/30179, both entitled "Portable Hand-Held Concrete and Mortar Mixer", which are incorporated by reference herein.

The mixer disclosed in the '098 patent is manufactured by the applicant. A pre-existing garden cultivator was modified, by changing the mixing blades and a shallow plastic mixing tub provided for containing the material to be mixed.

After an extended period of use, the peripheral ring extending about the mixing blades disclosed in the '098 patent wears in the region where the peripheral ring engages the mixing tub floor and the tub side walls.

The mixer utilized in the device set forth in the '098 patent has a blade assembly made up of a hub, a stamped blade portion, a peripheral rim and a series of tines attaching the peripheral ring to the stamped blade portion. The resulting structure, particularly when mounted adjacent a like or generally similar blade assembly becomes particularly difficult to clean, especially when the mixer is equipped with an upper shroud.

SUMMARY OF THE INVENTION

A portable mixer is provided for mixing materials in an open top mixing container having a bottom and a pair of generally vertical side wall surfaces. The mixer includes a rotatable generally horizontal shaft which is centrally mounted relative to the mixer and having opposed distal ends. A pair of intermediate blades are affixed to the rotary shaft between a central support and each of the opposed distal ends. A pair of outboard mixing blade assemblies are affixed outboard the intermediate blades adjacent the shaft distal ends. The outboard mixing blade assemblies include a central hub affixed to the rotary shaft, a peripheral ring coaxially aligned perpendicular to the rotary shaft having an outside diameter greater than that of the intermediate blades to prevent the intermediate blades from engaging the container bottom surface. A plurality of spokes join the central hub of the peripheral ring. A plurality of rotary disk blades are mounted pivotally on the plurality of spokes. The rotary disk blades are sufficiently large to cause the rotary disk blades to extend outwardly beyond the peripheral ring to engage the mixing container sidewalls.

One of the advantages of the present invention is that the rotary disk blades space the peripheral ring from the sidewalls thereby reducing peripheral ring wear and the useful life of the mixing blade assembly.

Another advantage of the present invention is that the generally open spoke arrangement facilitates easy cleaning of the outboard mixing blade as well as the intermediate mixing blade without removal of the mixing blades from the rotary shaft.

DESCRIPTION OF THE PREFERRED EMBODIMENT

Figures 1, 2:
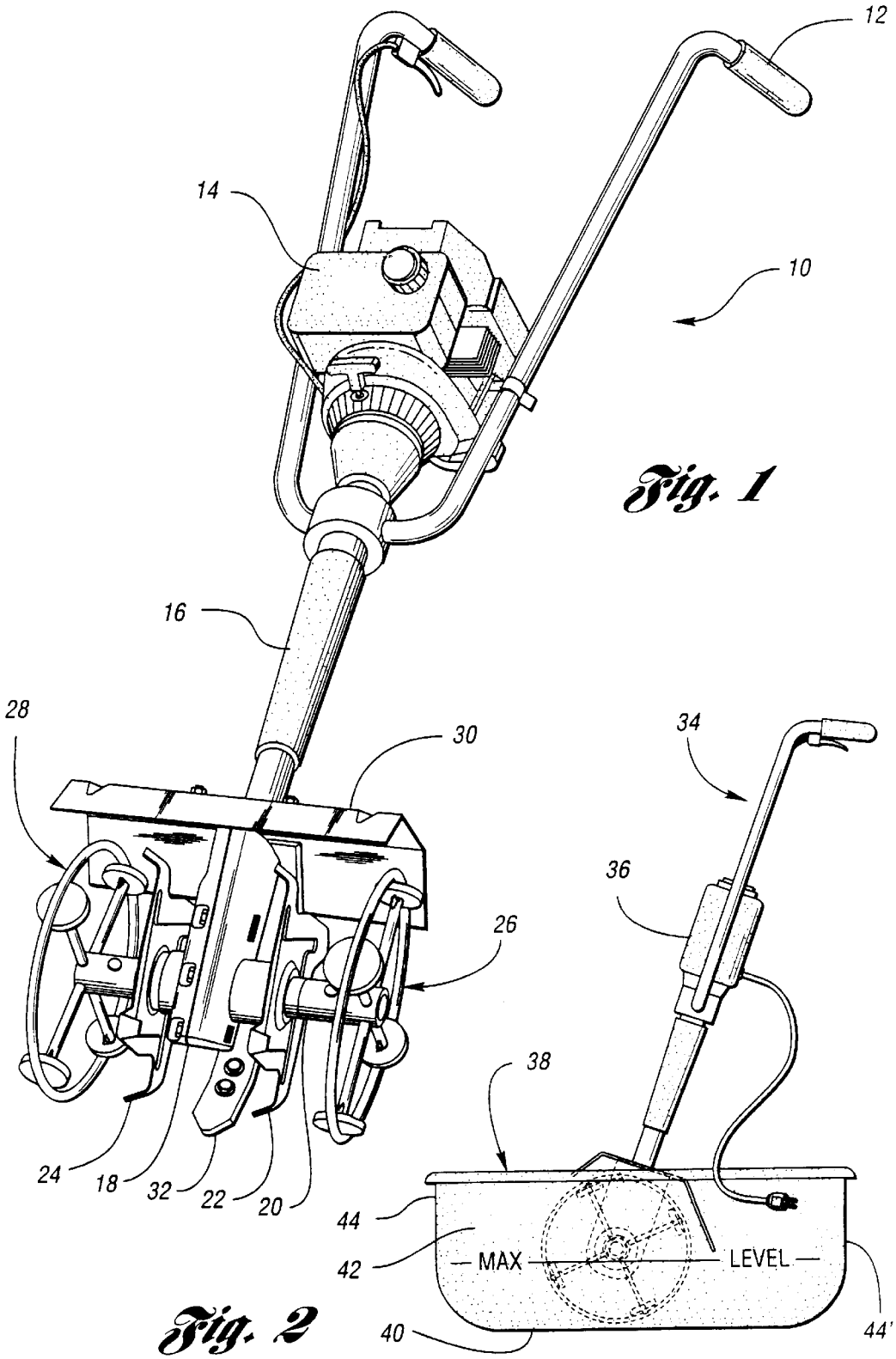
FIG. 1 is a perspective view illustrating a portable hand-held mixer incorporating the present invention.
FIG. 2 is a side elevational view of an electric motor driven embodiment of the invention and an associated open top mixing container.

FIG. 1 illustrates a portable hand-held mixer 10 of the present invention. Mixer 10 is built off of a standard Ryobi garden cultivator platform. The mixer is provided with a pair of handles 12 for the user, a motor 14 having a rotary output shaft, a tubular frame member 16 through which the rotary output shaft extends and a gear box 18. Gear box 18 is mounted on the tubular frame and is provided with an internal gear set to convert high speed rotation of the motor output shaft to a relatively low speed rotation of a generally horizontal rotary shaft 20. Rotary shaft 20 is centrally supported by gear box 18 and is provided with a pair of generally opposed distal ends extending transversely on opposite sides of the gear box. Removably affixed to rotary shaft 20 are two pairs of mixing blades, immediate mixing blades 22 and 24; an outboard mixing blade assemblies 26 and 28. Mixing blades 22–28 are affixed to the rotary shaft 20 by a headed through bolt and a cotter pin.

In the preferred embodiment, a mixer is further provided with a shroud 30 oriented generally between the rotary mixing blades and the user. Preferably, the mixer is additionally provided with a central plow 32 having a flexible plastic tip for scraping the bottom of the mixing container.

It should be appreciated that motor 14 can be of a variety of types. In the FIG. 1 embodiment, motor 14 is illustrated as an internal combustion engine. The motor can be of a two-cycle or four-cycle configuration depending upon the user or manufacturer's preference. Alternatively, as illustrated in FIG. 2, mixer assembly 34 is functionally identical to mixer 10, however, an electric AC corded motor is utilized as a source of rotary power. Of course, a DC motor and battery can alternatively be used if the application is so required. Electric motors are particularly useful when the mixer is intended to be used indoors, for example, when mixing grout or epoxy for a large title ceramic or stone project.

As illustrated in FIG. 2, the mixer 34 is used in conjunction with an open top mixing container such as plastic tub 38. Plastic tub 38 has a generally flat bottom 40; a pair of generally vertical sidewalls 42 (one of which is shown) and a pair of post end walls 44. Preferably, the mixer and tub are used with the tub partially filled so that thorough mixing can occur without excessively loading the mixer motor. As illustrated in FIG. 2, preferably plastic tub 38 is provided with molded indicia indicating the maximum level of the material to be mixed. The tub has sufficiently high walls in order to prevent the mixed material from splashing out of the tub during normal use. As further illustrated in FIG. 2, the radius of the transition between the tub bottom surface 40 and end walls 44 generally corresponds to or is greater than the diameter of outboard blade assemblies 26 and 28 (indicated in phantom outline).

The radius at the transition between the bottom surface 40 of the tub and the side walls 42 is much smaller and can approximate a right angle since outboard mixing blade assemblies 26 and 28 can effectively mix into these two perpendicular extending junctions.

Figure 3:
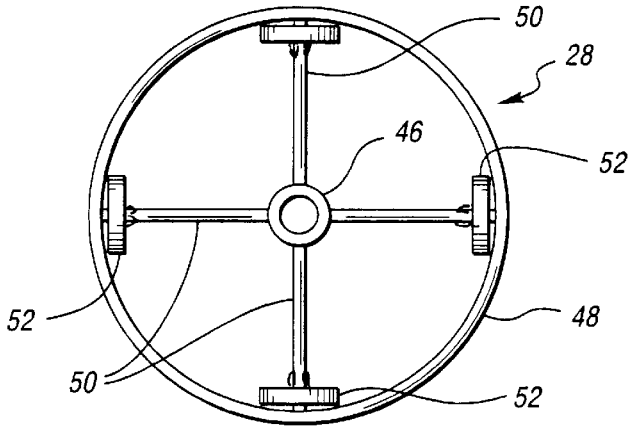
FIGS. 3 and 4 are an axial and a radial view of a first embodiment of an outboard mixing blade assembly.
Figure 4:
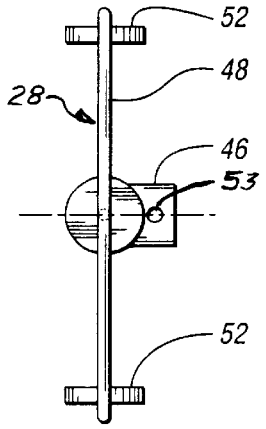

The structure of the outboard blade assembly 28 can be better seen in FIGS. 3 and 4 which are an axial end view and a radial side view of the outboard mixing blade assembly 28. Outboard mixing blade assembly 28 is made up of four main components; a central hub 46, a peripheral ring 48, a plurality of spokes 50 and a plurality of rotary disc blades 52. Central hub 46 is formed of a short length of steel tube sized to telescopically fit over rotatable shaft 20. Central hub 46 is provided with a through hole 53 perpendicular to the rotary shaft axis through which a headed through bolt may be inserted so that the outboard mixing blade assembly can be retained to the rotary shaft using a through bolt and a corresponding cotter pin or threaded nut.

Peripheral ring 48 is generally coaxially aligned with the rotatable shaft 20 and central hub 46. Peripheral ring 48 lies in a plane which is generally perpendicular to rotary shaft 20. Peripheral ring 48 is affixed to central hub 46 by a plurality of spokes 50. The spokes illustrated are generally radial, however, spokes may deviate from radial and more or fewer spokes may be utilized than illustrated. In the embodiment of the outer mixing blade assembly 28 illustrated, the central hub 46, the peripheral ring 48 and the spokes 50 are welded together to form a unitary assembly.

Pivotally mounted upon the plurality of spokes 50 is a plurality of rotary disc blades 52. The blades are generally circular having a central aperture sized to rotatably fit upon the spokes. Rotary disc blades 52 are maintained in proper orientation on the spokes by either a washer and cotter pin or alternatively, the spoke may be deformed with an upset die to enlarge the spokes sufficiently to limit radial movement of the rotary display. In the first outboard mixing blade assembly embodiment illustrated in FIGS. 3 and 4, mixing blade assembly 28 has all four rotary disc blades 52 at approximately the same radial distance from hub 46. It may be desirable in some instances, to orient the rotary disc blades at two or more different radial distances from hub 46.

The rotary disc blades 50 have the central aperture sized so that they may freely rotate on the spokes 50. However, in use particularly when mixing cement or mortar, aggregate particles work their way into the region between the rotary disc blade aperture and the spoke, limiting or totaling preventing rotation. The temporary freezing of the rotary disc blade during use does not hinder performance. The disc blades mix cement quite well. When the outboard mixing blade assembly is cleaned subsequent to use, the blades can then be freed. This enables the blades to rotate so that they are not in the same position during every mixing operation. Rotating the discs periodically enables the discs to wear evenly and have a life comparable to the life of the peripheral ring.

The plurality of disc blades 52 have a diameter which is sufficiently large to cause a portion of the rotary disc blades to extend outwardly beyond the peripheral ring 48 as illustrated in FIG. 4 thereby enabling the rotary disc blades 52 to engage the mixing container side walls 42. This design prevents side wear on peripheral ring 48 which is now only subject to wear along its circumferential surfaces due to engagement with the container bottom surface. In the preferred embodiment of the outboard mixing blade assembly illustrated, all of the components are fabricated from cold rolled steel which is easy to weld and fabricate. When worn, the outboard mixing blade assembly 28 can simply be replaced. Of course, if extended wear life is desired, the outer peripheral surface of peripheral ring 48 can be clad with a more wear resistant material such as carbide and rotary disc blades 52 can be formed of a carbide material as well.

Figure 5:
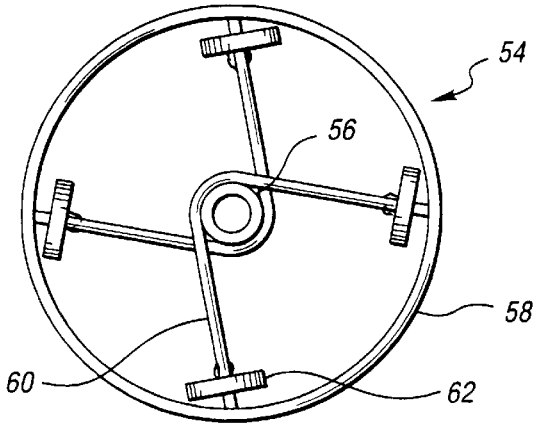
FIGS. 5 and 6 are an axial and a radial view of a second embodiment of an outboard mixing blade assembly.
Figure 6:
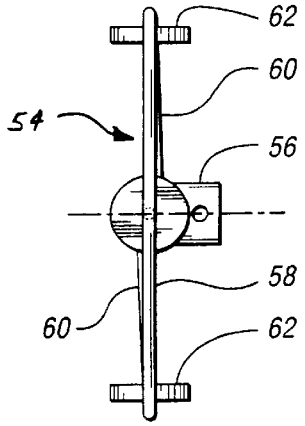

A second alternative outboard mixing blade embodiment 54 is illustrated in FIGS. 5 and 6. Outboard mixing blade assembly 54 is similar to first embodiment 28 and is provided with a central hub 56, a peripheral ring 58, a plurality of spokes 60 and a plurality of rotary disc blades 62. Spokes 60 are formed in pairs as illustrated in FIG. 5 by bending a steel rod to form an included angle somewhat less than 90 degrees. This spoke orientation results in the spokes deviating somewhat from a radial line drawn between the peripheral ring and the ring center line. The resulting deviation of the spokes from normal at the peripheral ring causes the rotary blades to have an increased silhouette area as opposed to a blade mounted on a radial spoke in the embodiment illustrated in FIG. 5 with the spoke locally oriented 90° to the peripheral ring 58. The rotary disc blades alternatively displace the mixed media radially inward and radially outward as the blades rotate through the mixture.

Figure 7:
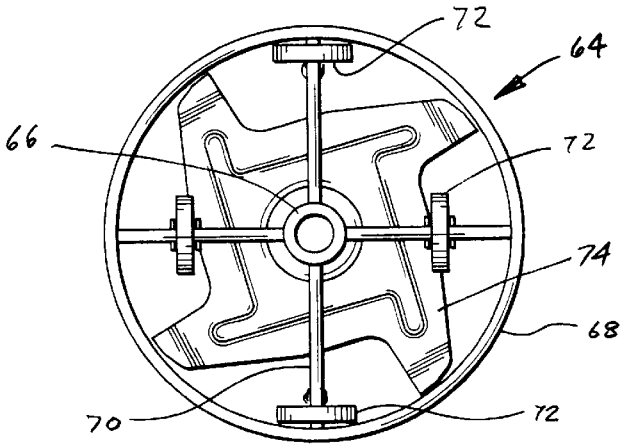
FIGS. 7 and 8 are an axial and a radial view of a third embodiment of an outboard mixing blade assembly.
Figure 8:
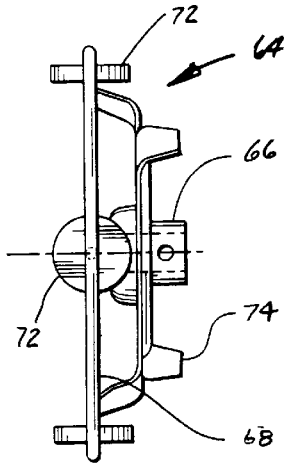

A third outboard mixing blade assembly embodiment 64 as illustrated in FIGS. 7 and 8 are an axial view and a radial side view, respectively. Outboard mixing blade assembly 64 is made up of five components; a central hub 66, a peripheral ring 68, a plurality of spokes 70, a plurality of rotary discs 72 and a stamped multi-tine mixing blade 74. Outboard mixing blade assembly 64 differs from the earlier embodiments 28 and 54 primarily by the addition of the stamped multi-tine mixing blade 74 and the fact that rotary discs 72 are alternatively located at different outboard radial spacings relative to hub 66. Preliminary testing indicates that the addition of the stamped multi-tine mixing blade does not seem to significantly improve mixing, however, the addition of the multi-tine mixing blade makes cleaning of the outboard and intermediate mixing blades more difficult. The stamped multi-tine mixing blade 74 illustrated is identical to the blade utilized on intermediate mixing blade assemblies 22 and 24 which in turn is the same mixing blade utilized in the Ryobi garden cultivator.

It is also understood, of course, that while the form of the invention herein shown and described constitutes a preferred embodiment of the invention, it is not intended to illustrate all possible forms thereof. It should also be understood that the words used in the specification are words of description rather than limitation and various changes may be made without departing from the spirit and scope of the invention.

What is claimed:

1. An improved outboard mixing blade assembly for a portable hand-held mixer adapted to be rotated in an open top mixing container having a bottom surface and a pair of generally vertical side wall surfaces, the hand-held mixer having a centrally supported rotary shaft with opposed distal ends, a pair of intermediate blades each affixed to the rotary shaft between a shaft central support and one of the opposed distal ends, and a pair of outboard mixing blade assemblies each affixed to the rotary shaft adjacent one of said opposed distal ends, each of said outboard mixing blade assemblies comprising:

a central hub adapted to be fixed to the rotary shaft of the mixer;

a peripheral ring generally coaxially aligned with and lying perpendicular to said rotary shaft and having an outside diameter greater than that of the intermediate blades so as to prevent the intermediate blades from engaging the container bottom surface;

a plurality of spokes joining the central hub to the peripheral ring; and a plurality of rotary disc blades each pivotally mounted on one of the plurality of spokes, the rotary disc blades each having a diameter sufficiently large to cause a portion of the rotary disc blade to extend outwardly beyond the peripheral ring to engage the side wall surfaces of the mixing container.

2. The invention of claim 1 wherein the plurality of spokes extend radially outward from the central hub and attach to the peripheral ring in a normal orientation.

3. The invention of claim 1 wherein the plurality of spokes are tangentially attached to an outboard surface of the central hub and extend therefrom to the peripheral ring where they attach in a non-normal orientation.

4. The invention of claim 1 wherein the plurality of rotary disc blades are pivotally mounted to the plurality of spokes at more than one radial distance from the central hub.

5. A portable hand-held mixer for mixing cement in an open top mixing container having a generally flat bottom surface and a pair of generally vertical side walls, the portable hand-held mixer comprising:

a frame having a handle to be grasped by a user, a motor mounted on the frame and having a rotary output member, a gear box mounted to the frame having a gear set driven by the rotary output member and having a generally horizontal centrally supported rotary shaft with opposed distal ends;

intermediate blade assemblies each affixed to the rotary shaft between the gear box and one of the opposed distal ends;

a pair of outboard mixing blade assemblies each affixed to the rotary shaft adjacent one of said opposed distal ends, each of the outboard mixing blade assemblies having a central hub adapted to be fixed to a rotary shaft of the mixer;

a peripheral ring generally coaxially aligned with and lying perpendicular to said rotary shaft and having an outside diameter greater than that of the intermediate blades so as to prevent the intermediate blades from engaging the container bottom surface;

a plurality of spokes joining the central hub to the peripheral ring; and a plurality of rotary disc blades each pivotally mounted on one of the plurality of spokes, the rotary disc blades each having a diameter sufficiently large to cause a portion of the rotary disc blade to extend outwardly beyond the peripheral ring to engage the mixing container side walls.

6. The invention of claim 5 wherein the plurality of spokes extend radially outward from the central hub and attach to the peripheral ring in a normal orientation.

7. The invention of claim 5 wherein the plurality of spokes are tangentially attached to an outboard surface of the central hub and extend therefrom to the peripheral ring where they attach in a non-normal orientation.

8. The invention of claim 5 wherein the plurality of rotary discs blades are pivotally mounted to the plurality of spokes at more than one radial distance from the central hub.

* * * * *